US008514233B2

(12) United States Patent
Semiannikov et al.

(10) Patent No.: US 8,514,233 B2
(45) Date of Patent: Aug. 20, 2013

(54) NON-GRAPHICS USE OF GRAPHICS MEMORY

(75) Inventors: Dmitry Semiannikov, Sunnyvale, CA (US); Korhan Erenben, Mississauga (CA); Raja Koduri, Santa Clara, CA (US)

(73) Assignees: Advanced Micro Devices, Inc., Sunnyvale, CA (US); ATI Technologies ULC, Markham, Ontario (CA)

( * ) Notice: Subject to any disclaimer, the term of this patent is extended or adjusted under 35 U.S.C. 154(b) by 581 days.

(21) Appl. No.: 12/359,071

(22) Filed: Jan. 23, 2009

(65) Prior Publication Data

US 2010/0188411 A1 Jul. 29, 2010

(51) Int. Cl.
*G09G 5/39* (2006.01)

(52) U.S. Cl.
USPC ..... 345/531; 711/151

(58) Field of Classification Search
None
See application file for complete search history.

(56) References Cited

U.S. PATENT DOCUMENTS

| | | | | |
|---|---|---|---|---|
| 5,659,336 | A * | 8/1997 | Patrick et al. | 345/545 |
| 5,875,474 | A | 2/1999 | Fabrizio | |
| 6,295,068 | B1 * | 9/2001 | Peddada et al. | 345/419 |
| 6,842,180 | B1 | 1/2005 | Maiyuran | |
| 7,818,806 | B1 * | 10/2010 | Gyugyi et al. | 726/24 |
| 7,831,780 | B2 * | 11/2010 | Aguaviva | 711/151 |
| 2002/0116576 | A1 | 8/2002 | Keshava | |
| 2007/0165042 | A1 * | 7/2007 | Yagi | 345/557 |
| 2009/0077320 | A1 * | 3/2009 | Hoover et al. | 711/130 |
| 2009/0147017 | A1 * | 6/2009 | Jiao | 345/582 |
| 2011/0107040 | A1 * | 5/2011 | Hanes | 711/154 |

OTHER PUBLICATIONS

International Search Report and Written Opinion for International Application No. PCT/US2010/022018 mailed Apr. 29, 2010.

* cited by examiner

*Primary Examiner* — Ke Xiao
*Assistant Examiner* — Weiming He
(74) *Attorney, Agent, or Firm* — Volpe and Koenig, P.C.

(57) ABSTRACT

Embodiments of a method and apparatus for using graphics memory (also referred to as video memory) for non-graphics related tasks are disclosed herein. In an embodiment a graphics processing unit (GPU) includes a VRAM cache module with hardware and software to provide and manage additional cache resourced for a central processing unit (CPU). In an embodiment, the VRAM cache module includes a VRAM cache driver that registers with the CPU, accepts read requests from the CPU, and uses the VRAM cache to service the requests. In various embodiments, the VRAM cache is configurable to be the only GPU cache or alternatively, to be a first level cache, second level cache, etc.

9 Claims, 5 Drawing Sheets

NON-GRAPHICS USE OF GRAPHICS MEMORY

TECHNICAL FIELD

Embodiments as disclosed herein are in the field of memory management in computer systems.

BACKGROUND

Most contemporary computers, including personal computers as well as more powerful workstations, have some graphics processing capability. This capability is often provided by one or more special purpose processors in addition to the central processing unit (CPU). Graphics processing is a task that requires a relatively large amount of data. Accordingly, GPUs typically have their own graphics memories (also referred to as video memories or video random access memory (VRAM)). All computer systems are limited in the amount of data they can process in a given amount of time. One of the limiting factors of performance is availability of memory. In particular the availability of cache memory affects system performance.

FIG. 1 is a block diagram of various elements of a prior art computer system 100. System 100 includes an operating system (OS) 104 that executes on a CPU. The OS 104 has access to memory including a disk 106. The amount of memory 106 that is allocated for cache is small in absolute terms compared to the amount of graphics memory 108 available on GPU 102. In addition, graphics direct memory access (DMA) is approximately 20-100 times faster than access to disk 106. However, OS 104 does not have direct access to GPU memory 108, even if the GPU 102 is not performing graphics processing.

Currently when systems that have GPUs and GPU memories are not performing graphics processing, the GPU memory is essentially unused (approximately 90% of VRAM is unused during non-graphics work). It would be desirable to provide a system in which the CPU could access the memory resources of the GPU to increase system performance.

The drawings represent aspects of various embodiments for the purpose of disclosing the invention as claimed, but are not intended to be limiting in any way.

DETAILED DESCRIPTION

Embodiments of a method and apparatus for using graphics memory (also referred to as video memory or video random access memory (VRAM)) for non-graphics related tasks are disclosed herein. In an embodiment a graphics processing unit (GPU) includes a VRAM cache module with hardware and software to provide and manage additional cache resourced for a central processing unit (CPU). In an embodiment, the VRAM cache module includes a VRAM cache driver that registers with the CPU, accepts read requests from the CPU, and uses the VRAM cache to service the requests. In various embodiments, the VRAM cache is configurable to be the only GPU cache or alternatively, to be a first level cache, second level cache, etc.

Figure 1:
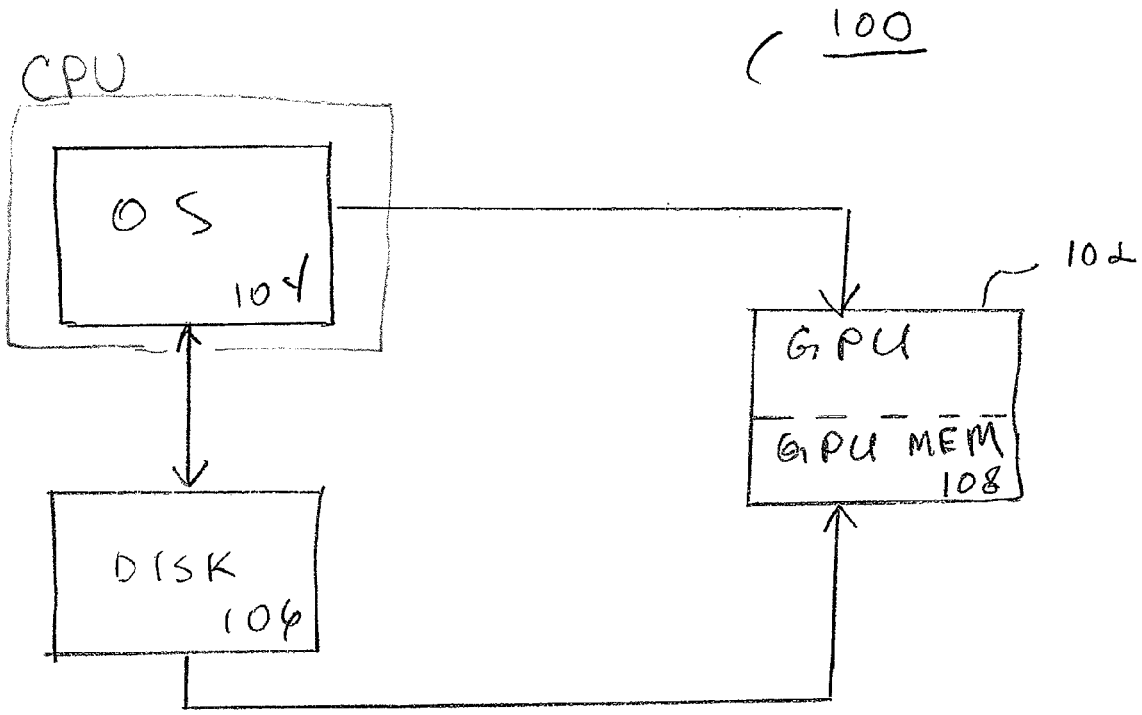
FIG. 1 PRIOR ART
FIG. 1 is a diagram of prior art system including a graphics processing unit (GPU)
Figure 2:
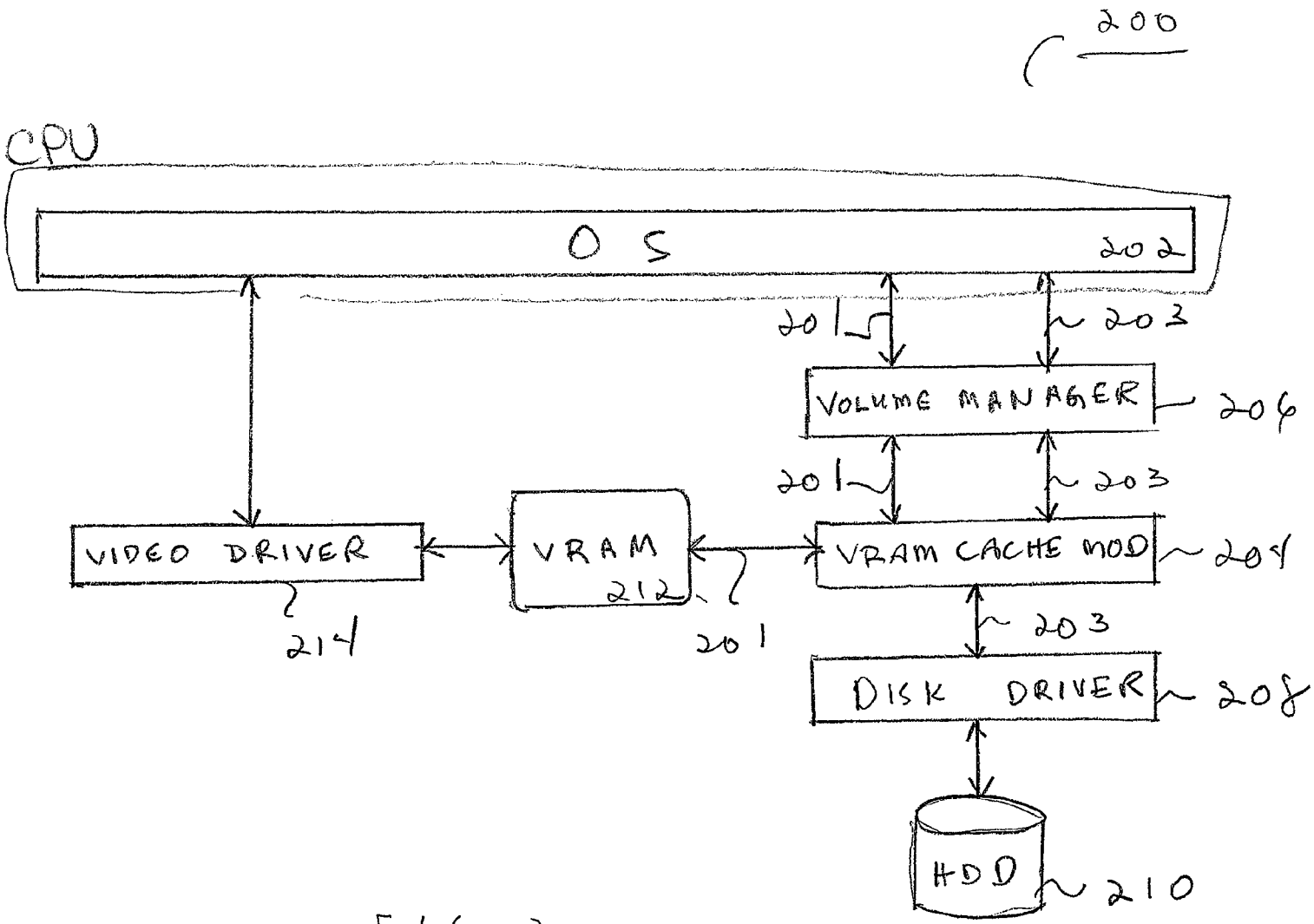
FIG. 2 is a block diagram of various components of a system according to an embodiment.

FIG. 2 is a block diagram of various components of a system 200 according to an embodiment. System 200 includes an OS 202, and a volume manager 206. System 200 further includes a disk driver 208 and a hard disk drive (HDD, or system memory, or physical storage device) 210. System 200 includes graphics processing capability provided by one or more GPUs. Elements of the one or more GPUs include a video driver 214, and a VRAM (or video memory) 212. Interposed between the volume manager 206 and the disk driver 208 is a VRAM cache module 204. In an embodiment VRAM cache module 204 includes a VRAM cache driver that is a boot time upper filter driver in the storage stack of the system 200. The VRAM cache module 204 processes read/write requests to HDD 210 and is unaware of any high level file system related information.

In an embodiment the VRAM cache driver is divided into four logical blocks (not shown): an initialization block, including PnP (Plug'n'Play), power, etc.; an IRP (I/O Request Packet) queuing and processing block; a cache management block handling cache hits/misses, least recently used (LRU) list, etc.; and a GPU programming block.

Figure 5:
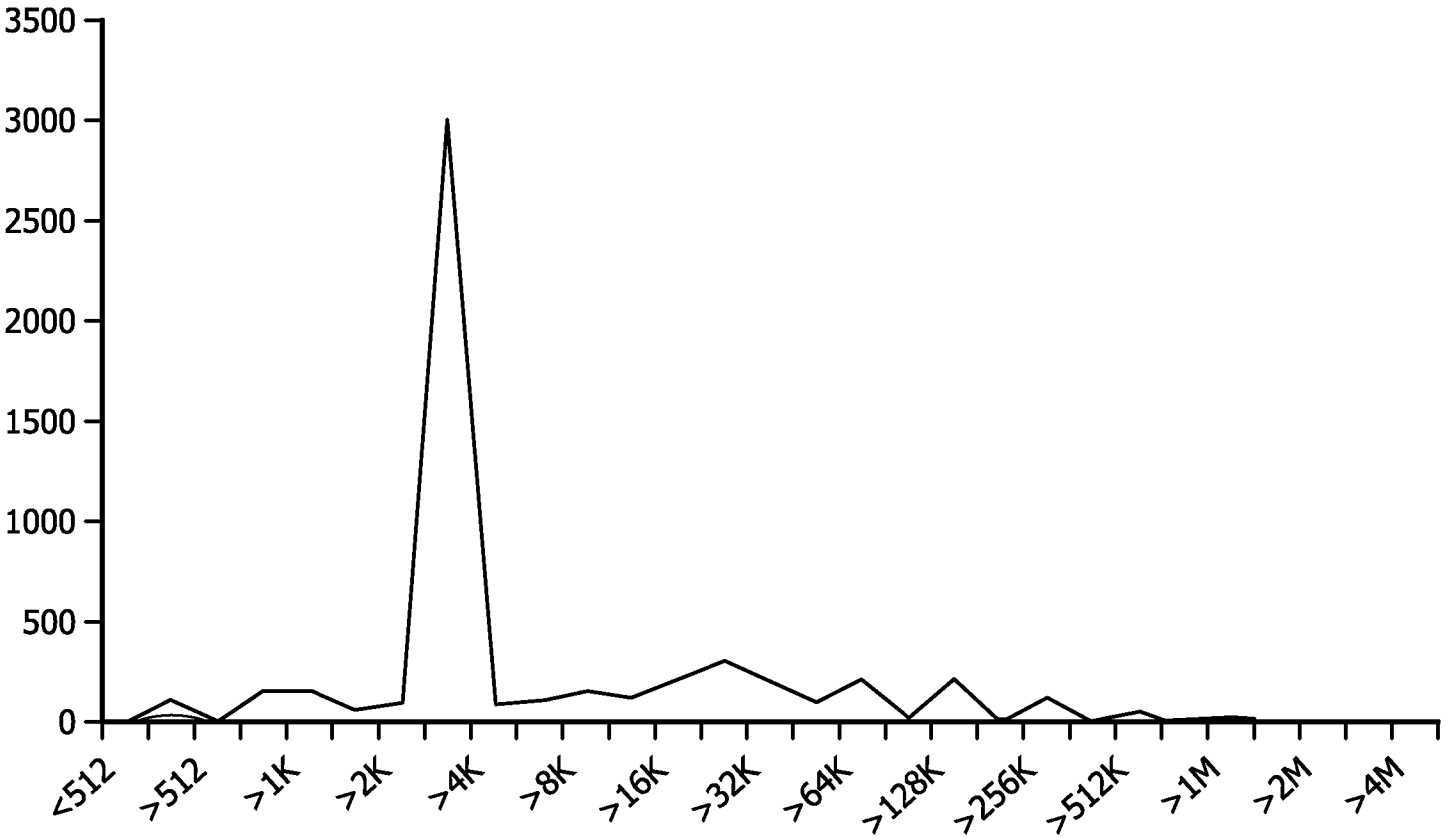
FIG. 5 is a graph of I/O statistics for Windows XP™ read requests.

Various caching algorithms are usable. According to just one example caching algorithm, the size of one cache entry is selected to be large enough to minimize lookup time and size of supportive memory structures. For example, the cache entry is in the range of 16K-256K in an embodiment. Another consideration in choosing the size of cache entries involves particularities of the OS. For example, Windows™ input/output (I/O) statistics can be taken into consideration. FIG. 5 shows I/O statistics for Windows XP™ read requests, where the X-Axis is I/O size and the Y-Axis is the number of requests.

Most of requests are less than the foregoing example selected caches entry size, which necessitates reading more than requested. However, from a disk IO perspective reading 4K takes the same amount of time as reading 128K, because most of the time taken is HDD seek time. Thus such a scheme is essentially "read ahead" with almost zero cost in terms of time. It may be necessary to allocate additional non-paged memory in order to supply a bigger buffer for such operations. One example eviction algorithm is based on one LRU list which is updated upon each cache hit.

In an embodiment the VRAM cache driver is loaded before any other driver component from a video subsystem. The VRAM cache driver is notified when all necessary video components are loaded and the GPU is initialized. The VRAM cache driver can be called as a last initialization routine, for example.

Memory supplied to (or allocated by) VRAM cache driver can be taken back by properly notifying the VRAM cache driver. According to one embodiment, such as for a particular operating system, the VRAM cache allocates memory in several chunks, and when the CMM (customizable memory management) fails to satisfy a request for local memory (e.g. when a 3D application is starting) it calls the VRAM cache driver, so it can free one or more memory chunks.

Figure 3:
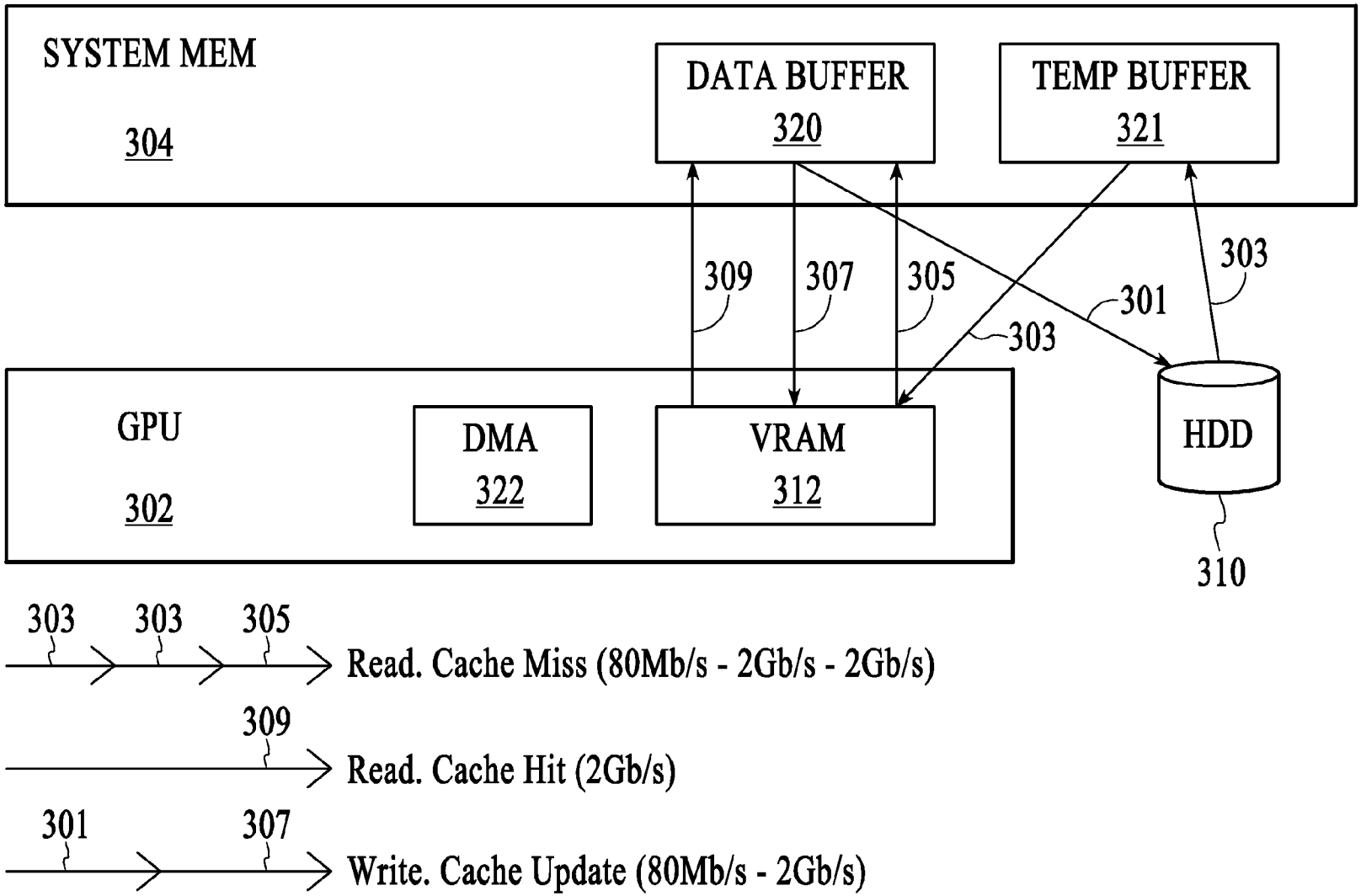
FIG. 3 is a block diagram illustrating a data flow between a system memory and a GPU according to an embodiment.

FIG. 3 is a block diagram illustrating a data flow between a system memory 304 and a GPU 302 according to an embodiment. The system memory 304 includes a data buffer 320 and a temporary buffer 321. The GPU 302 includes a DMA engine 322 and a VRAM 312. Arrows 303 and 305 show the flow of a "Read, Cache-Miss". Arrow 309 shows the flow if a "Read, Cache Hit". Arrows 301 and 307 show the flow of a "Write, Cache Update". Example data rates for the flows are shown in the legend at the bottom of the figure. Other rates are possible.

Figure 4:
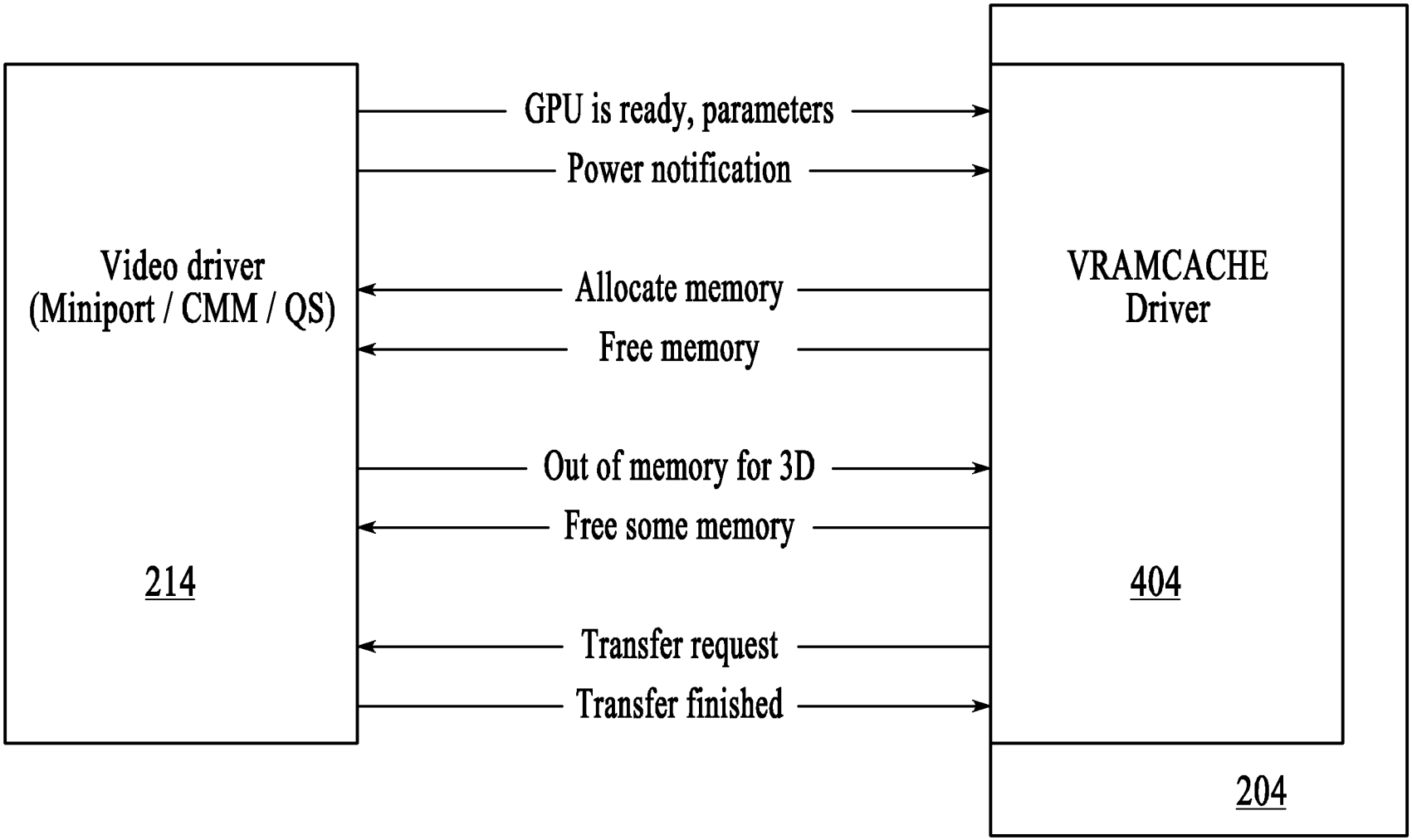
FIG. 4 is a block diagram illustrating communication between a video storage stack of a video driver and a VRAM cache driver of a VRAM cache module according to an embodiment.

FIG. 4 is a block diagram illustrating communication between a video storage stack of a video driver 214 and a VRAM cache driver 404 of a VRAM cache module 204. The video storage stack is functional when the video subsystem could be sleeping.

The video driver 214 sends messages to the VRAM cache driver 404 to indicate that the GPU is ready (also sending parameters), and an indication of a power state. The VRAM cache driver 404 sends messages to the video driver 214 to allocate memory and to free memory. When the video driver 214 sends a message to the VRAM cache driver 404 that it is out of memory for 3D operations, the VRAM cache driver 404 responds with a message to free memory. The VRAM cache driver 404 sends a transfer request to the video driver 214, and the video driver 214 sends a transfer-finished message to the VRAM cache driver 404. VRAM cache driver 404 should be notified when a requested transfer is complete, for example by calling its DPC (Delayed Procedure Call) routine.

Any circuits described herein could be implemented through the control of manufacturing processes and maskworks which would be then used to manufacture the relevant circuitry. Such manufacturing process control and maskwork generation are known to those of ordinary skill in the art and include the storage of computer instructions on computer readable media including, for example, Verilog, VHDL or instructions in other hardware description language.

Aspects of the embodiments described above may be implemented as functionality programmed into any of a variety of circuitry, including but not limited to programmable logic devices (PLDs), such as field programmable gate arrays (FPGAs), programmable array logic (PAL) devices, electrically programmable logic and memory devices, and standard cell-based devices, as well as application specific integrated circuits (ASICs) and fully custom integrated circuits. Some other possibilities for implementing aspects of the embodiments include microcontrollers with memory (such as electronically erasable programmable read only memory (EEPROM), Flash memory, etc.), embedded microprocessors, firmware, software, etc. Furthermore, aspects of the embodiments may be embodied in microprocessors having software-based circuit emulation, discrete logic (sequential and combinatorial), custom devices, fuzzy (neural) logic, quantum devices, and hybrids of any of the above device types. Of course the underlying device technologies may be provided in a variety of component types, e.g., metal-oxide semiconductor field-effect transistor (MOSFET) technologies such as complementary metal-oxide semiconductor (CMOS), bipolar technologies such as emitter-coupled logic (ECL), polymer technologies (e.g., silicon-conjugated polymer and metal-conjugated polymer-metal structures), mixed analog and digital, etc.

The term "processor" as used in the specification and claims includes a processor core or a portion of a processor. Further, although one or more GPUs and one or more CPUs are usually referred to separately herein, in embodiments both a GPU and a CPU are included in a single integrated circuit package or on a single monolithic die. Therefore a single device performs the claimed method in such embodiments.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "hereunder," "above," "below," and words of similar import, when used in this application, refer to this application as a whole and not to any particular portions of this application. When the word "or" is used in reference to a list of two or more items, that word covers all of the following interpretations of the word, any of the items in the list, all of the items in the list, and any combination of the items in the list.

The above description of illustrated embodiments of the method and system is not intended to be exhaustive or to limit the invention to the precise forms disclosed. While specific embodiments of, and examples for, the method and system are described herein for illustrative purposes, various equivalent modifications are possible within the scope of the invention, as those skilled in the relevant art will recognize. The teachings of the disclosure provided herein can be applied to other systems, not only for systems including graphics processing or video processing, as described above. The various operations described may be performed in a very wide variety of architectures and distributed differently than described. In addition, though many configurations are described herein, none are intended to be limiting or exclusive.

The teachings of the disclosure provided herein can be applied to other systems, not only for systems including graphics processing or video processing, as described above. The various operations described may be performed in a very wide variety of architectures and distributed differently than described. In addition, though many configurations are described herein, none are intended to be limiting or exclusive.

In other embodiments, some or all of the hardware and software capability described herein may exist in a printer, a camera, television, a digital versatile disc (DVD) player, a DVR or PVR, a handheld device, a mobile telephone or some other device. The elements and acts of the various embodiments described above can be combined to provide further embodiments. These and other changes can be made to the method and system in light of the above detailed description.

In general, in the following claims, the terms used should not be construed to limit the method and system to the specific embodiments disclosed in the specification and the claims, but should be construed to include any processing systems and methods that operate under the claims. Accordingly, the method and system is not limited by the disclosure, but instead the scope of the method and system is to be determined entirely by the claims.

While certain aspects of the method and system are presented below in certain claim forms, the inventors contemplate the various aspects of the method and system in any number of claim forms. For example, while only one aspect of the method and system may be recited as embodied in computer-readable medium, other aspects may likewise be embodied in computer-readable medium. Such computer readable media may store instructions that are to be executed by a computing device (e.g., personal computer, personal digital assistant, PVR, mobile device or the like) or may be instructions (such as, for example, Verilog or a hardware description language) that when executed are designed to create a device (GPU, ASIC, or the like) or software application that when operated performs aspects described above. The claimed invention may be embodied in computer code (e.g., HDL, Verilog, etc.) that is created, stored, synthesized, and used to generate GDSII data (or its equivalent). An ASIC may then be manufactured based on this data.

Accordingly, the inventors reserve the right to add additional claims after filing the application to pursue such additional claim forms for other aspects of the method and system.

What is claimed is:

1. A graphics processing method comprising:

receiving, by a video random access memory (VRAM) cache driver of a graphics processing unit (GPU), memory access requests from a central processing unit (CPU), wherein the memory access requests are for a non-graphics related task, the GPU having a video random access memory (VRAM) configured for use as cache for the CPU;

determining, by the VRAM cache driver, that the GPU is initialized based on signals received from a video driver of the GPU;

allocating, by the video driver, memory in VRAM for use as cache for the CPU in response to receiving allocating messages from the VRAM cache driver;

deallocating, by the video driver, memory in the VRAM for use as cache for the CPU in response to receiving deallocating messages from the VRAM cache driver; and processing, by the CPU, the non-graphics related task of the memory access requests using the VRAM.

2. The method of claim 1, further comprising configuring the GPU memory as one or more of a GPU memory, a first level cache, or a second level cache.

3. The method of claim 1, further comprising configuring a cache entry size.

4. The method of claim 1, wherein the deallocating further comprises:

the video driver sending a request to the VRAM cache driver that the GPU requires a transfer of VRAM memory access presently allocated to the CPU; wherein the deallocating messages from the VRAM cache driver are in response to the request.

5. A system comprising:

a central processing unit (CPU);

a system memory coupled to the CPU; and at least one graphics processing unit (GPU) comprising;

a video random access memory (VRAM);

a VRAM cache module coupled to the VRAM and to the system memory and configurable as memory for non-graphics related operations on behalf of the CPU;

a video driver coupled to the VRAM cache module, wherein the video driver receives memory access requests from the CPU for a non-graphics related task for processing by the CPU using the VRAM;

the VRAM cache module configured to determine that the GPU is initialized based on a signal received from the video driver; and the video driver configured to allocate memory in VRAM for use as cache for the CPU in response to receiving allocating messages from the VRAM cache module; and the video driver further configured to deallocate memory in the VRAM for use as cache for the CPU in response to receiving deallocating messages from the VRAM cache module.

6. The system of claim 5, wherein the VRAM cache module comprises an initialization block, a Plug 'n' Play (PnP) block, a processing block, and a cache management block.

7. A non-transitory computer readable medium having stored thereon instructions that when executed in a processing system, cause a memory management method to be performed, the method comprising:

accepting, by a video random access memory (VRAM) cache driver of a graphics process unit (GPU), the GPU having associated memory, memory access requests from a central processing unit (CPU), wherein the memory access requests are for a non-graphics related task; the GPU having a video random access memory (VRAM) configured for use as cache for the CPU;

determining, by the VRAM cache driver, that the GPU is initialized based on signals received from a video driver of the GPU;

allocating, by the video driver, memory in VRAM for use as cache for the CPU in response to receiving allocating messages from the VRAM cache driver;

deallocating, by the video driver, memory in the VRAM for use as cache for the CPU in response to receiving deallocating messages from the VRAM cache driver; and processing, by the CPU, the non-graphics related task of the memory access request using the VRAM.

8. The non-transitory computer readable medium of claim 7, wherein the method further comprises configuring the GPU memory as one or more of a GPU memory, a first level cache, and a second level cache.

9. The non-transitory computer readable medium of claim 8, wherein the method further comprises configuring a cache entry size.

* * * * *